US006533626B2

(12) United States Patent
Pons

(10) Patent No.: US 6,533,626 B2
(45) Date of Patent: Mar. 18, 2003

(54) ON-BOARD DEVICE FOR RESCUING A PERSON FROM THE SEA ENABLING A CONSCIOUS PERSON TO RESCUE HIMSELF

(76) Inventor: Michel Pons, 100 Avenue des Allies, 06140 Vence (FR)

( * ) Notice: Subject to any disclaimer, the term of this patent is extended or adjusted under 35 U.S.C. 154(b) by 0 days.

(21) Appl. No.: 10/022,393

(22) Filed: Dec. 20, 2001

(65) Prior Publication Data

US 2002/0119715 A1 Aug. 29, 2002

Related U.S. Application Data

(63) Continuation of application No. PCT/FR99/01448, filed on Jun. 16, 1999.

(30) Foreign Application Priority Data

Jun. 23, 1998 (FR) ..... 98 07887

(51) Int. Cl.[7] ..... B63C 9/00
(52) U.S. Cl. ..... 441/80; 441/84
(58) Field of Search ..... 441/80, 81, 84, 441/85

(56) References Cited

U.S. PATENT DOCUMENTS 4,343,056 A 8/1982 McDonald
4,498,879 A * 2/1985 Burr ..... 441/28
5,192,238 A 3/1993 Brown
5,374,211 A * 12/1994 Imazato ..... 114/365
5,435,766 A 7/1995 Epstein
6,379,207 B1 * 4/2002 Castagner et al. ..... 441/85

FOREIGN PATENT DOCUMENTS

DE 38 09 264 9/1989
FR 2 066 831 8/1971
FR 2 623 771 6/1989
FR 2638705 A1 * 5/1990 ..... B63C/9/20

* cited by examiner

*Primary Examiner*—Jesus D. Sotelo
(74) *Attorney, Agent, or Firm*—Young & Thompson

(57) ABSTRACT

Onboard device for the recovery of a person overboard permitting self-recovery by a conscious victim.

The floating trailing end (1) is adapted to be recovered by the person in the sea and serves as a control means to actuate the release of the towrope floating element (3), said floating element (3) is connected to the boat by an end serving as a towrope (4) and a comprising at least one means serving as a shock absorber (5); said flotation element is provided with towrope attachments and is symmetrical; said flotation element (3) has a hydrodynamic shape and entirely or partially supports the victim (6) with a minimum of resistance to pulling through water.

The invention is applicable to boats.

8 Claims, 10 Drawing Sheets

ON-BOARD DEVICE FOR RESCUING A PERSON FROM THE SEA ENABLING A CONSCIOUS PERSON TO RESCUE HIMSELF

This application is a continuation of PCT/FR99/01448, filed Jun. 16, 1999.

FIELD OF THE INVENTION

The invention has for its object an onboard device for rescuing a person from the sea permitting a conscious person to rescue himself.

BACKGROUND OF THE INVENTION

The state of the art can be defined by the following material:

round life preservers,

U shaped life preservers in the form of horse collar, life preservers in triangular or square shape, of various rigid and inflatable materials.

These life preservers do not guarantee flotation because the victim is involuntary and may not have donned his life preserver before falling over or else has no one else to throw him one. Even if the victim has a life preserver, he remains in the water awaiting rescue by another person. The same is true for the following material:

floating devices of rectangular shape of different sizes such as life preserver cushions of aircraft or else larger ones of ships with ropes to be gripped, life vests of rigid foam or inflatable;

sealed and inflatable combinations, life rafts of different sizes, rigid or inflatable, that can receive one or several tens of persons, personal signaling material: whistles, mirrors, lamps, fires, coloring agents, radio emitters for satellite positioning, etc.

Often, when a victim falls into the sea, he has none of the above equipment.

Studies of various organizations concerned with maritime safety show that there exist three critical stages in saving someone from the sea:

1—supplying flotation equipment,

2—establishing physical contact with the victim,

3—bringing the victim onboard.

Existing equipment, products or techniques to solve the problem are incomplete because they rely on one or two stages leading to rescue.

For example:

1) flotation:

there exist lifesavers (in the form of rings, horseshoes, etc.), life vests of rigid foam or inflatable of any shape and even an inflatable life raft, for one person and which the victim is supposed to take with him when going overboard. The mentioned equipment supply flotation but the contact with the boat which continues on its course is lost and this does not permit bringing the victim onboard. Others offer the possibility of hoisting the victim but only in the case in which the latter floats besides the boat. Poles are adapted to mark the position in the water of the victim as well as a radio signal which transmits by satellite his exact position but which lacks two of the three critical stages of lifesaving.

In the case of someone who falls into the sea, if he does not have a life jacket or lifesaver, it is impossible to guarantee that the other members of the crew can give him a flotation aid. If the mariner is alone, it is certain that no one will come to hi said immediately. When other persons are onboard, no one may have noticed his fall (example: the mariner is on watch while the others sleep), the other members of the crew can find it impossible to maneuver the boat correctly and return to the point of fall to supply the flotation element. There exist several possible reasons.

Hence, the only solution for a victim to float, is that the wear a life vest or a preserver before falling or else that there exists a rescue element in the water, beside the victim which the latter can immediately seize.

2) establish contact with the victim:

A lone victim or without a witness is slot.

If the victim is not connected with the boat by means of a rope, the physical contact is lost and must be reestablished.

If a crewmate moves the boat a distance while maneuvering it, it is difficult for him to maintain visual contact with the victim. An automatic or manual mechanism could throw onto the water position equipment such as a pole with a flag, or a radio satellite transmission. At night, the crew would lose sight of the victim if he is not provided with a signal lamp, similarly the victim would have difficulty finding a lifebuoy if he does not have a lamp.

To establish contact, the boat should return and stop exactly at the spot where the person is in the water, under any circumstances. It is extremely difficult to carry out this maneuver while under sail, sometimes impossible in heavy weather, strong wind and high seas. If the crew brings the boat around into immediate adjacency, this often endangers the victim more than if the boat were to maintain a certain distance.

It could be attempted to establish contact by throwing a buoy attached to a cord but, so that the victim can grasp it and pull in, it is necessary that the be immobile on the water, otherwise it will be torn out of the hands of said victim will not have the time to reel it in. Moreover, this supposes that the boat is stopped.

In high winds, it is impossible to stop a sailboat, particularly a multi-hull which maintains a certain speed on the water. If contact is established with the victim by means of a rope, even if the victim has succeeded in putting on a vest or a buoy, he will be dragged by the boat which continues to advance. Moreover, in more than 70% of the bodies of water, the resistance to advance is such that the victim is quickly submerged and risks being sunk, requiring him or the other crew members to cut said cord, thereby losing physical contact.

Hence the only solution to establish and keep contact is to supply the victim with a flotation element attached to the boat, which is easy to grasp and which does not offer resistance to advance in the water when the victim is dragged behind a boat.

3) returning the victim onboard:

All the existing equipment supposes external assistance and is not suitable for a single mariner or someone without others capable of maneuvering in a storm.

What would work under conditions of calm seas and winds to throw a buoy attached to a cord and pull up to return the victim onboard, does not work if the boat is not stopped. As described above, the resistance is such that you can't drag the victim by the rope. On the other hand, if the boat manages to stop next to the victim, there often results a greater danger than if the boat kept a certain distance. When the edge of the boat is high above the water, the victim must be dragged up in a comfortable way, without danger, which presupposes a hoisting equipment.

Thus the only solution by which the victim can certainly return onboard, is that the be able to do it himself. Similarly, the rescue device must have hydrodynamic characteristics permitting the victim to be drawn by a rope, without resistance behind a boat and permitting the victim to pull himself up or be pulled up toward the boat and then over the side into the boat.

The following patents also define the state of the prior art.

FR-A-2.638.705: onboard safety device on a boat with a crew to alert the crew and its location for the recovery of someone fallen overboard, characterized in that it comprises first individual means for emitting at least an acoustic signal carried by each member of the crew, controlled by falling into the water, means for receiving this signal onboard the boat, control means of an assistance assembly actuated by this signal and second means for emitting and for receiving at least one radio signal between the person fallen into the seal and the boat.

FR-A-2.622.717: the invention relates to a device comprising an emitter and a receiver designed such that distance from the emitter triggers an alarm. The emitter is carried by the person to be monitored, departure from the emitter, by decreasing below a certain threshold the signal received by the fixed receiver on the boat, triggers an alarm. The device according to the invention is particularly adapted for the surveillance of persons onboard small boats.

FR-A-2.692.723: device for marking. It comprises a small balloon and a radar wave reflector, with three reflecting faces perpendicular to each other fixed at several points to the internal wall of the balloon, the points of securement being disposed only along two straight perpendicular lines, but not secants.

FR-A-2.695.904: the device is adapted to facilitate the rescue of a person fallen into the sea. It comprises at least an emitter emitting a coded signal and adapted to be borne by any person onboard the boat, a receiver detecting the coded signal and delivering a control signal when the coded signal is not detected and control means for the movement of the boat receiving the control signal from the receiver and comprising an electromagnetic device activated by the control signal and modifying the path of the boat when it is excited. In the case of a sailboat, the electromagnetic device is constituted by a winding located adjacent the compass of the autopilot of the boat. By means of an inclinometer and a detector of the route followed, the boat is made to turn around.

EP0 416 972: the installation for detecting a person leaving a boat, in which a circuit emits a low frequency interrogation signal to a loop disposed about the periphery of the deck. Emitter-receivers carried by each person onboard, when they detect the intense signal emitted by means of the loop, send a high frequency signal which is detected by the circuit. As the field is extremely weak outside the loop, a person falling into the sea is very well detected by the disappearance of the response of the emitter-receiver which has not received the interrogation signal.

U.S. Pat. No. 4,343,056 (McDONALD):

This patent describes a device for recovering someone who has fallen overboard. It uses a harness, a hoisting cable, pulleys and a beam to help him out of the water. The maneuver is carried out by a third person who acts onboard the craft.

This patent describes a device for recovering someone from the sea. The boat being stopped, he uses the mast, the guys and a set of pulleys to wind up an end held by a winch at the end of which is located a harness of a buoy. A boom permits the person to leave the water.

There is no self-recovery device, the ship must be stopped, the person overboard is immersed at the end of his towrope because of the speed of the boat in the water. The person overboard cannot raise himself entirely or in part to skim over the water.

U.S. Pat. No. 5,192,238 (BROWN):

This patent describes a rescue device from the sea, to recover someone who has fallen overboard. It uses a trailing rope to which the person overboard must attach himself by closing the hasp of a buckle, this trailing rope triggers the action of a floating anchor which acts by a return pulley on said rope to return the person from the sea toward the boat, below the water because the latter does not float.

There is no flotation element of the floating plank type.

FR 2.066.831 (BARON):

This patent describes a lifesaving device to save any passenger of a boat who falls overboard. Each person onboard carries an emitter which is triggered as soon as the person falls into the water and which drives different means to signal the fall, stop the boar, launch the equipment.

SUMMARY OF THE INVENTION

The onboard device for self-recovery of someone overboard who is conscious, if of the type using trailing floating and adapted to be recovered by the person overboard, a flotation element for the person overboard and emergency safety material for rescuing him. The floating end serves as a control means to actuate the release of the flotation element, said towable flotation element is connected to the boat by an end serving for towing and comprises at least one means serving as a shock absorber.

said flotation element is a floating plank and has a hydrodynamic form and supports the victim entirely or partially out of the water, with a minimum of resistance to traction in the water.

The flotation element is symmetrical on each side relative to its horizontal plane, inflatable and provides with towing attachments.

The flotation element comprises at least one gripping element serving as a handle and/or stirrup to help the overboard person out of the water.

The onboard device on the boat comprises a means serving as a hoist to hoist and raise the trailing line, the flotation element and the victim, onboard.

The hoist is onboard the boat.

The hoist is manual and onboard the floating element.

The hoist is electrical, triggerable remotely by control means such as the trailing line.

It comprises a launcher onboard the boat adapted to launch the flotation element connected to the trailing line in a container in the form of a shell.

The launcher, onboard the boat, adapted to launch the flotation element, is triggered by traction on the floating end or by a radio control carried by the victim, the control can be automatic upon contact with the water or else manually actuated.

the means serving as a hoist is a floating anchor secured at one of its ends to the end serving as a hoist whilst the other end is fixed to the floating plank, said end passing through a return pulley mounted onboard the boat.

The pulley is provided in its securement on the boat with a shock absorber.

The floating anchor is mounted on the floating plank or it could be released in the water by the victim.

BRIEF DESCRIPTION OF THE DRAWINGS

The accompanying drawings are given by way of indicative example and not in a limiting way. They represent a preferred embodiment according to the invention, they will permit easy understanding of the invention.

DESCRIPTION OF THE PREFERRED EMBODIMENT

Figure 1:
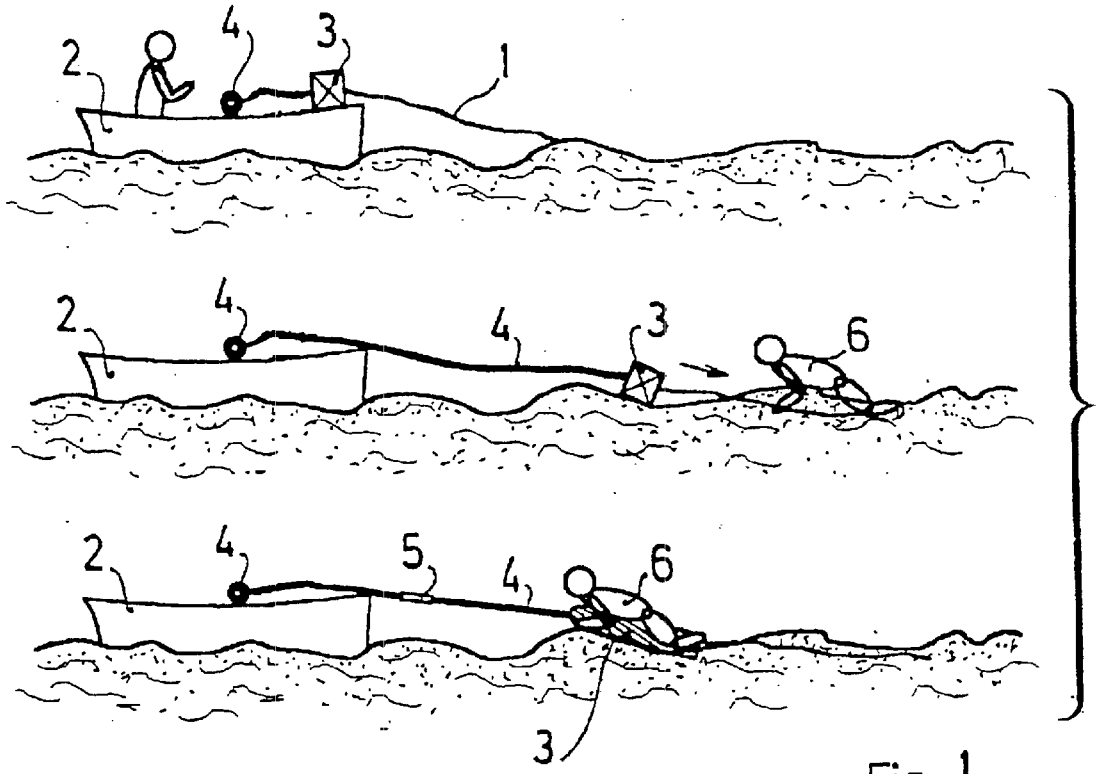
FIG. 1 is a schematic view of a boat provided with a trailing floating end, a flotation element connected to means serving as a trailer. Three schematic illustrations show this embodiment.

The onboard device for permitting a conscious person overboard to save himself, is the type using a floating end 1 as shown in FIG. 1, said floating end being connected to a flotation element 3, said flotation element 3 if to a flotation element 3, said flotation element 3 if desired containing safety and emergency material for lifesaving.

The floating trailing end 1 is adapted to be grapsed by someone in the sea because it serves as a control means for releasing the flotation element 3. Said flotation element 3 is itself connected to the boat 2 by an end serving as a trailer 4.

This end serving as a trailer 4 is provided with means 5 serving as a shock absorber.

As shown in FIG. 1, the three schematic drawings show that when the victim 6 falls into the sea, if he is conscious, can recover the floating end 1 and use the floating end as a control means to trigger the release of floating end as a control means to trigger the release of the flotation element 3.

The victim 6 can then hoist himself onto the flotation element 3 and lie flat and let himself be pulled by the towrope 4, the element serving as a shock absorber can easily permit the victim 6 to emplace himself without sudden movement due to the towing from the boat.

Figure 2:
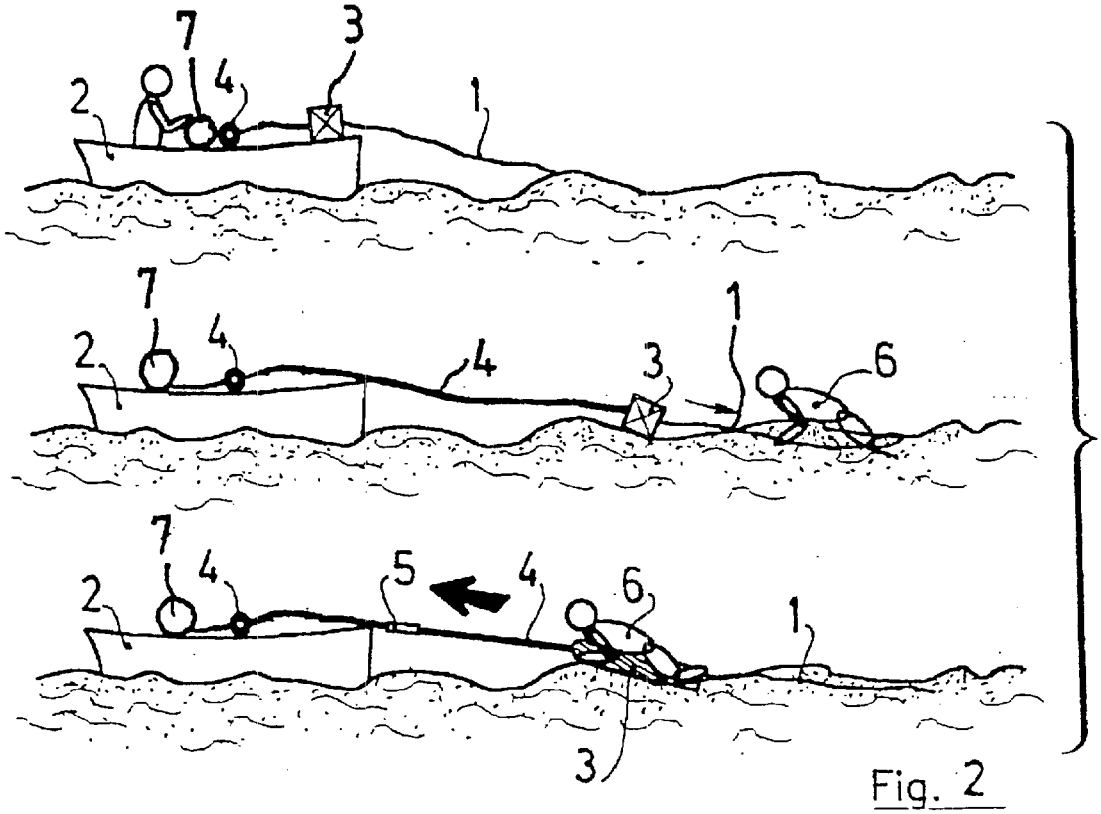
FIG. 2 is a schematic view of the boat provided with a trailing floating end, with a flotation element connected to the means serving as a trailing element and as a hoist. Three schematic views show this embodiment.

In the embodiment shown in FIG. 2, the boat is provided with a hoist 7 that is automatically started with a control means such as the towrope.

The victim can thus trigger the hoisting maneuver from the flotation element 3.

The hoist is arranged in such a manner on the boat 2 that the hoisting operation of the floating element permits raising and recovering onboard the flotation element 3 and the victim 6 who is connected to it.

Figure 3:
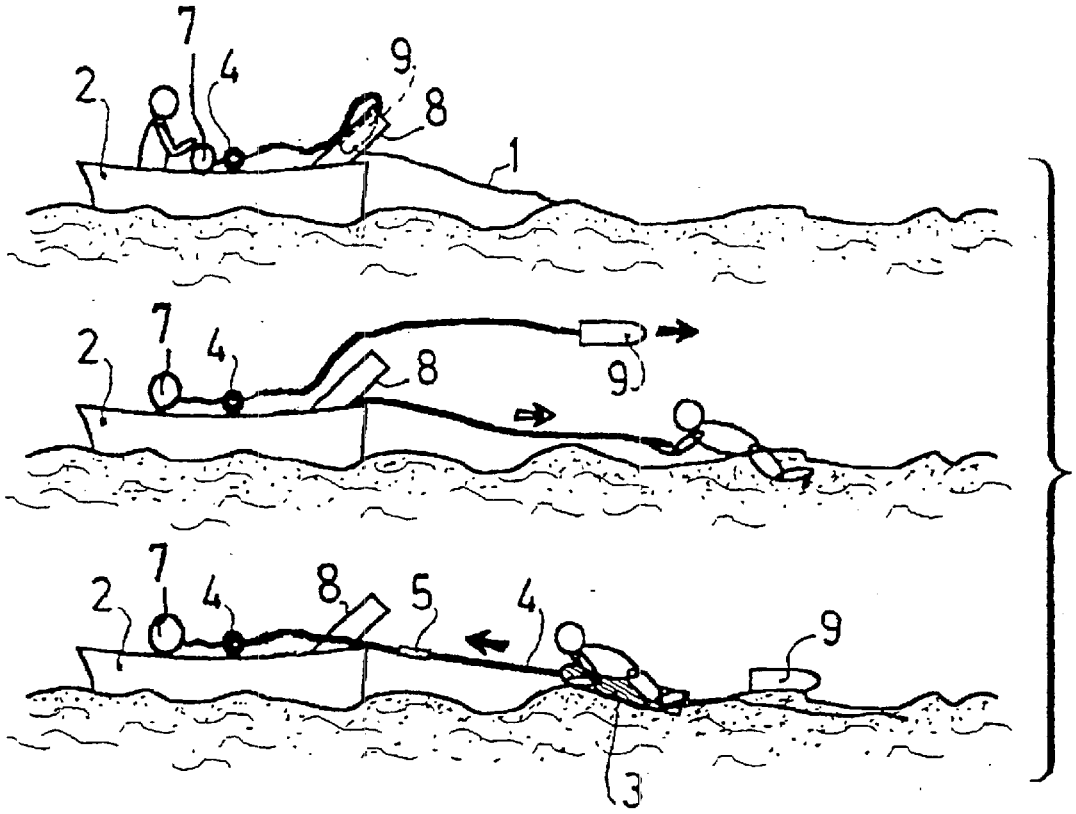
FIG. 3 is a schematic view of the boat provided with a floating trailing end, with a flotation element connected to a means serving as a trailer, with a launcher and a hoist. Three schematic views show this embodiment.

According to the embodiment shown in FIG. 3, the boat 2 is provided with a launcher 8, said launcher 8 is controlled by the floating trailing end 1 which serves as a control means to trigger the launching of a container 9, in which container is disposed the flotation element 3 and the towrope 4.

According to a preferred embodiment, the container 9 has the shape of a shell. The shell 9 is hollow to receive the flotation element 3 and the towrope 4.

Figure 4:
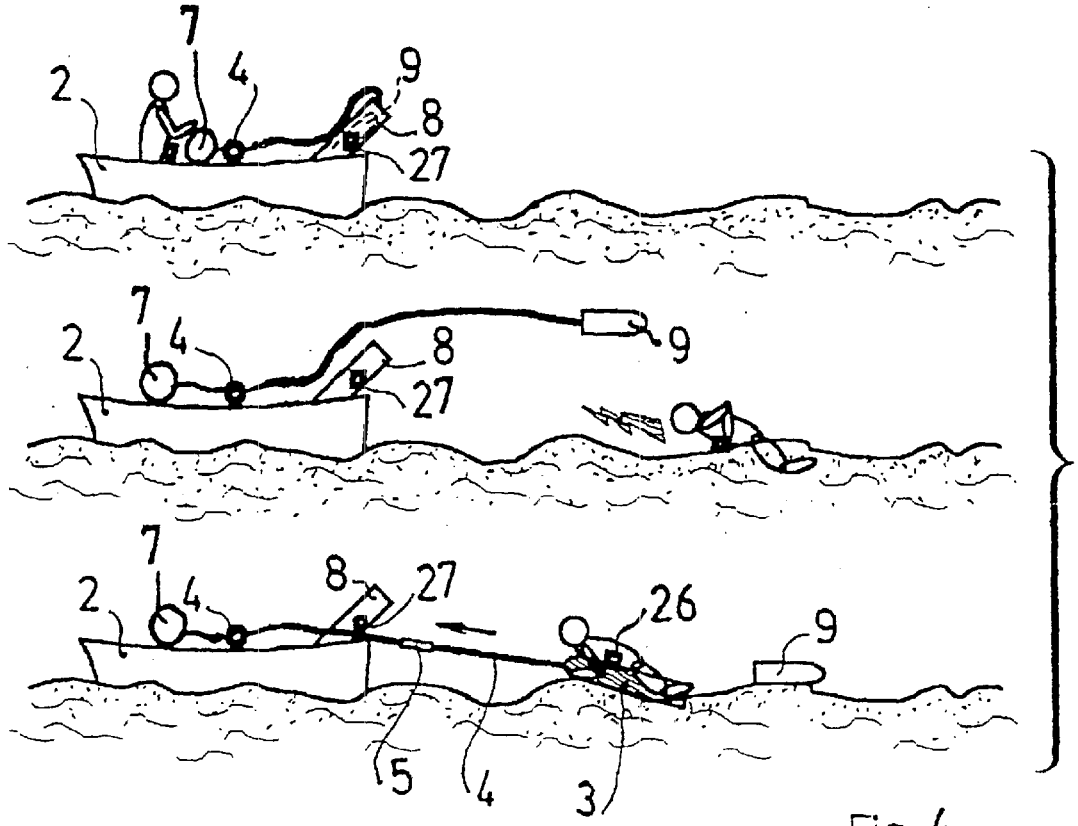
FIG. 4 is a schematic view of the boat provided with a flotation element, a means serving as a launcher remotely controlled by the victim falling into the water, with a container, and with a hoist.

According to another embodiment shown in FIG. 4, the victim 6 is provided with a radio control 26 which is triggered as soon as it is contact with the water and starts the launcher 8. The launcher 8 is also provided with a microreceiver 27 which activates the launcher. The radio control 26 can also be actuated manually.

Figure 5:
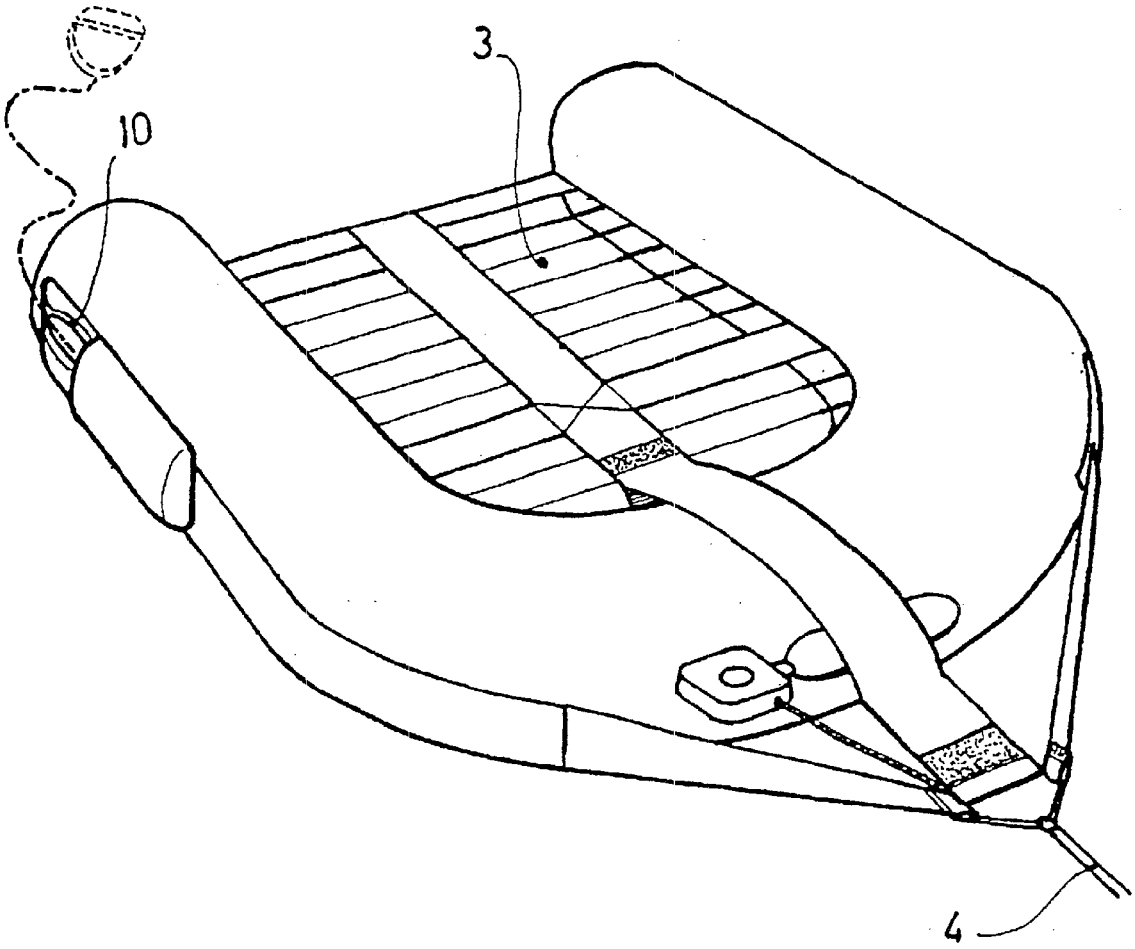
FIG. 5 is a perspective view of a flotation element.

FIG. 5 shows the flotation element 3 which comprises particularly a gripping element 10 which permits the victim 6 to use his handle as a stirrup to be held on the flotation element 3 particularly when the latter is hoisted and then recovered onboard the boat 2.

Figure 6:
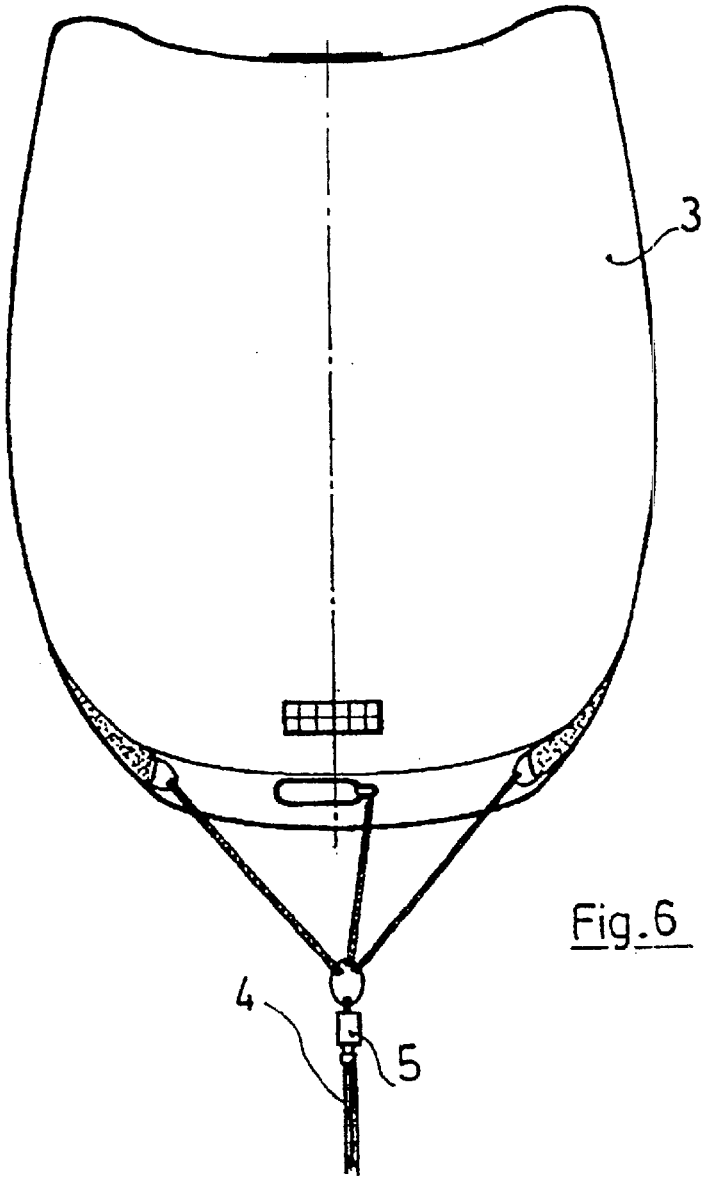
FIG. 6 is a top plan view of a flotation element according to another embodiment.
Figure 7:
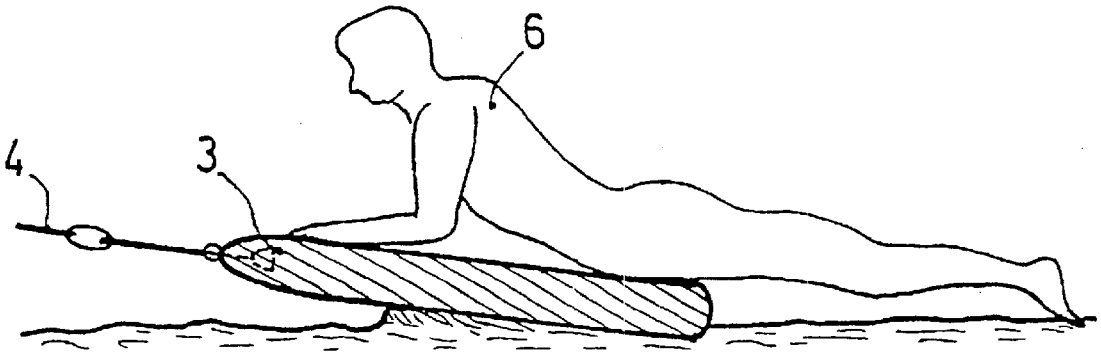
FIG. 7 is a longitudinal cross-sectional view of the flotation element in FIG. 6 with the victim disposed flat against it to be towed.
Figure 8:
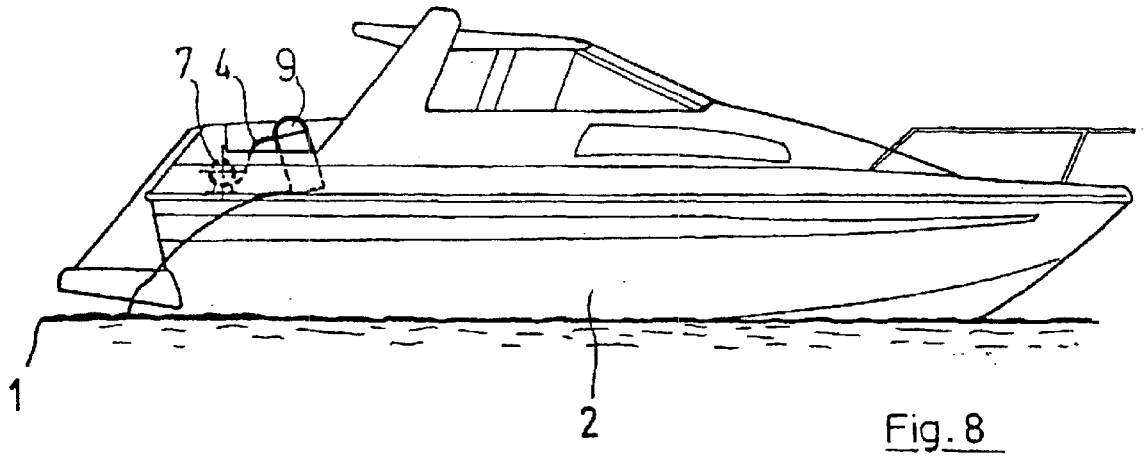
FIG. 8 is a side view of a boat with an onboard launcher and a floating trailing end.
Figure 9:
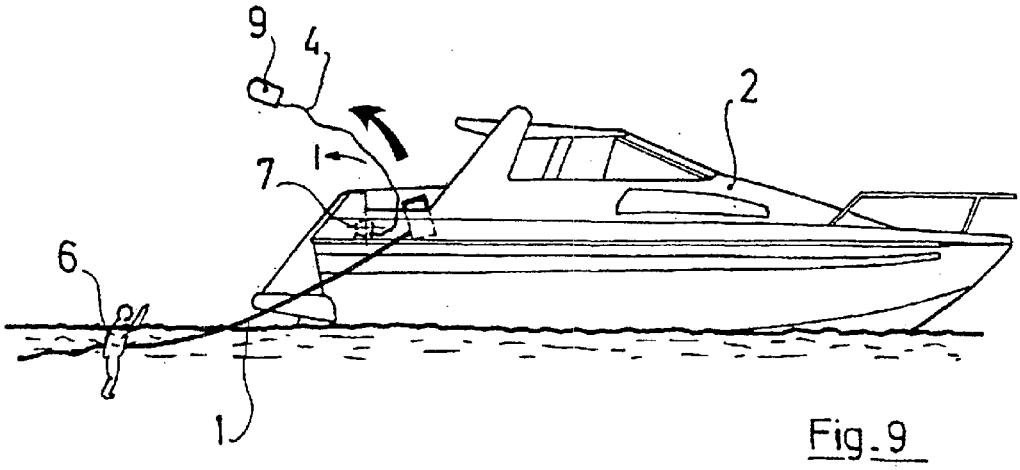
FIG. 9 is a view according to FIG. 5 in which the launcher has launched the container which contains the flotation element connected to the boat by a trailer.

FIGS. 6 and 7 show the technical characteristics of this flotation element which has particularly a hydrodynamic form, near that a mattress or a floating board, to support totally or partially the victim, as shown in FIG. 7 and this with a minimum of resistance to the water and the wind during towing of the flotation element 3 by the boat 2 when the latter continues its course.

Figures 10, 11:
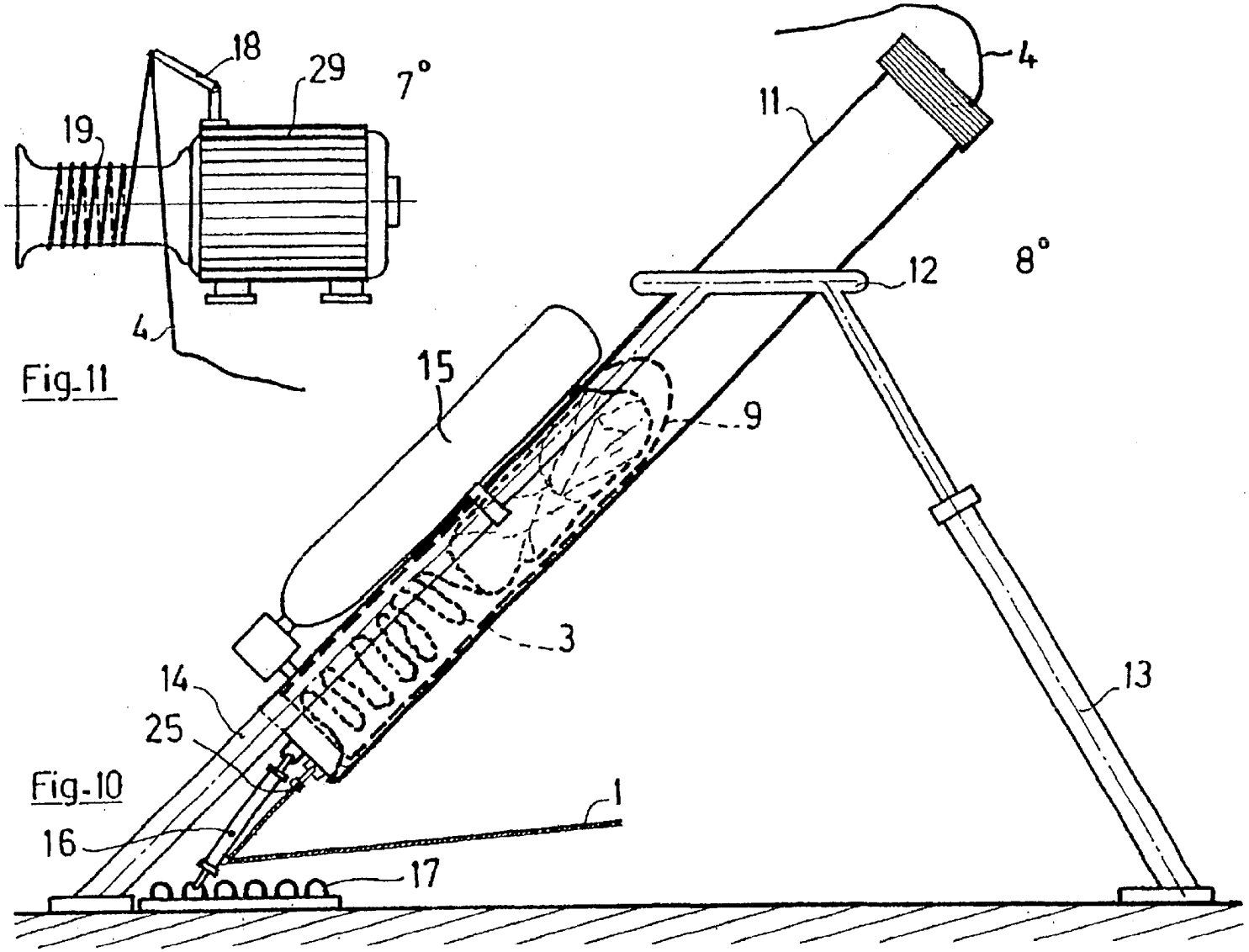
FIG. 10 is a schematic view of a launcher according to the device, which launcher contains a container in the form of a shell in which is disposed the flotation element.
FIG. 11 is a view of the hoist which is onboard the boat and which permits hoisting the flotation element and the victim onboard the boat, by means of the trailer.

FIG. 10 shows a launch 8 according to the device.

There is a cannon whose tube 11 is disposed on a support 12 with adjustable feet 13.

The support 12 receives the launcher which is actuated by means of a gas reserve 15.

The base of the cannot is fixed by an adjustable attachment 16.

The position of the different securement rings 17 thus permits the adjustment of the length of the feet 13, 14, to adjust the angle of fire of the launcher.

The actuating trigger 25 is connected to the floating trailing end 1. In the tube 11 of the cannot is disposed the container 9 which has the shape of a shell and which contains the flotation element 3. Said flotation element 3 is itself connected to the towrope 4.

FIG. 11 shows a hoist 7 with its electric motor which is actuated by a control lever 18 to which is connected the towrope 4.

The hoist 7 naturally comprises a winding drum 19.

Figure 12:
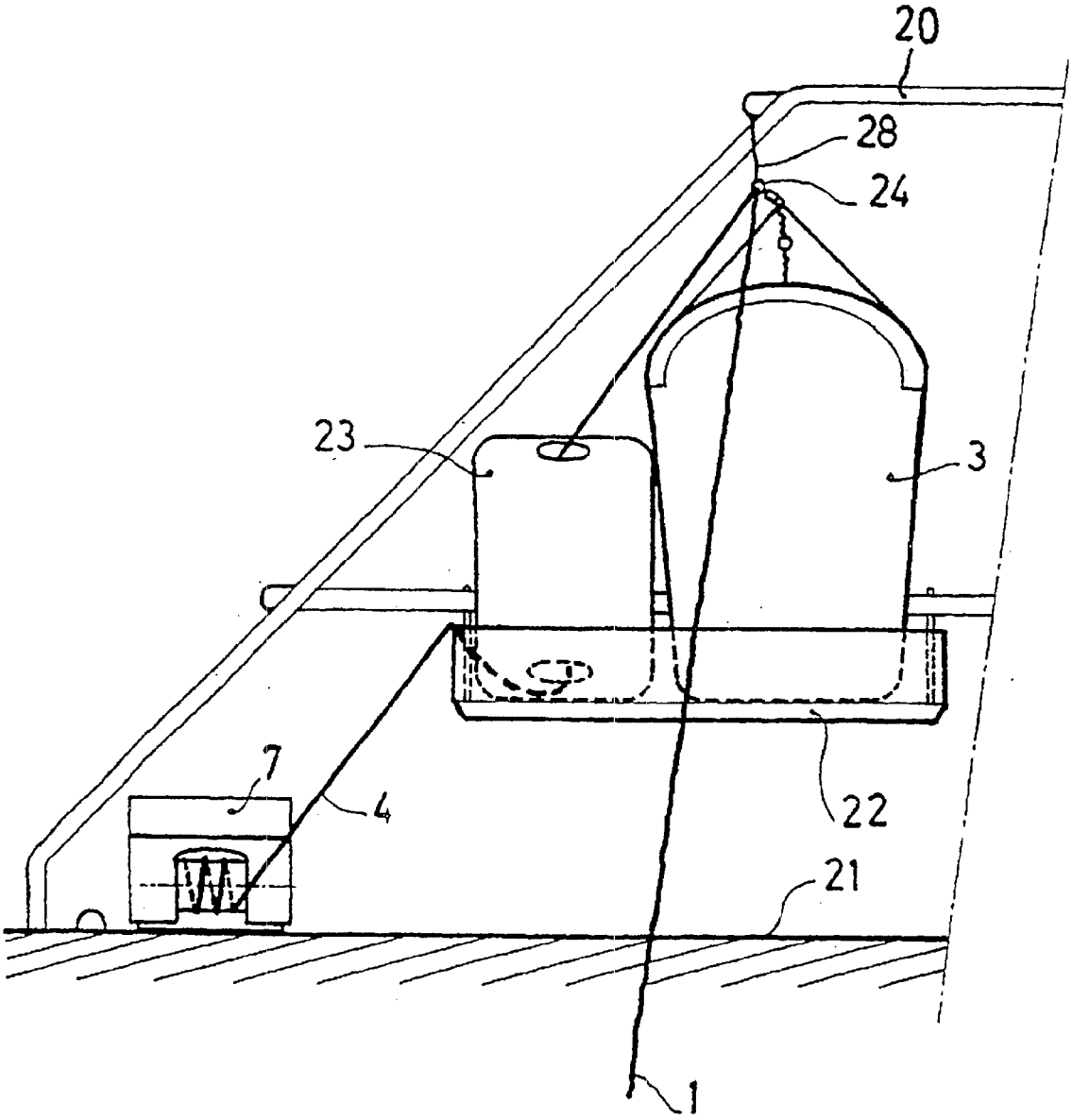
FIG. 12 is a view of an arrangement of hoist, flotation element and trailer.

FIG. 12 shows a possible embodiment or arrangement of hoist 7, towrope 4 and the folded up flotation element 3.

The assembly is disposed in the railing 20.

The hoist 7 is at the level of the deck 21, whilst a support 22 is fixed on the railing 20 from its upper side and in a position above the hoist 7.

This support 22 receives protective packaging 23 for the towrope 4 which is coiled in said package 23 and which is connected, at one end, to the hoist 7, whilst the other end is connected to the folded flotation element 3.

The flotation element 3 is disposed in the support 22 is unstable equilibrium, retained by a fragile cord 28 also connected by a ring 24 to the floating trailing end 1.

Violent traction by the victim 6 on the floating trailing end 1 breaks the fragile cord 28, which causes falling overboard of the folded flotation element 3 which was in unstable equilibrium above the water.

The flotation element 3 automatically inflates or not, if it is inflatable, and the victim 6 can have himself towed by clinging to the top of it.

The victim 6 can trigger his hoisting and his raising on board.

Figure 13:
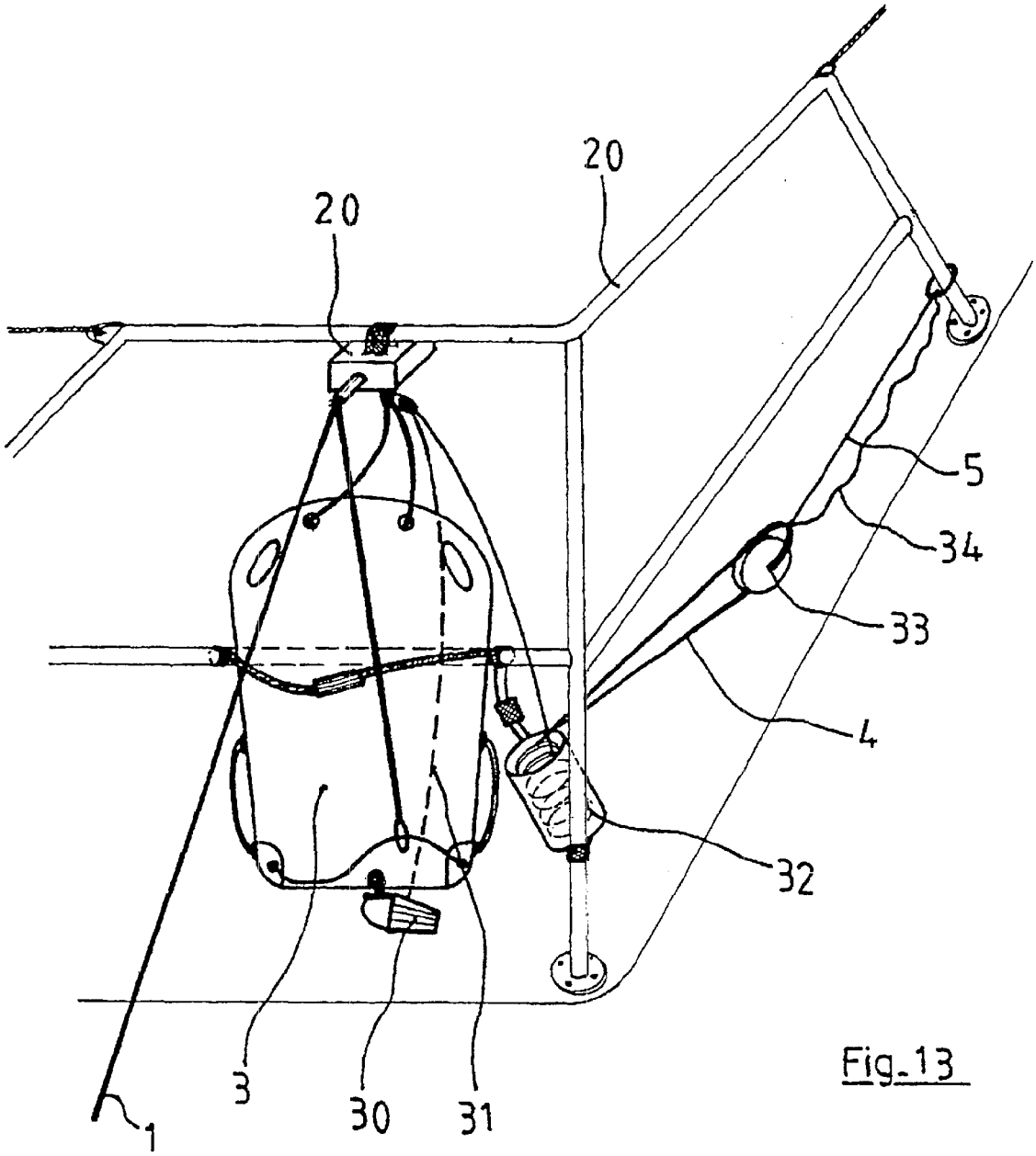
FIG. 13 is a view of the device with a fixed station onboard the boat. The means serving as a hoist for hoisting and raising the trailer, the flotation element and the victim onboard, is a fixed anchor bent over the flotation element and connected at one end of the trailer which, by the play of a pulley on the boat, permits, once deployed and released, hoisting the assembly with the speed of the boat (combined flotation element and victim).
Figure 14:
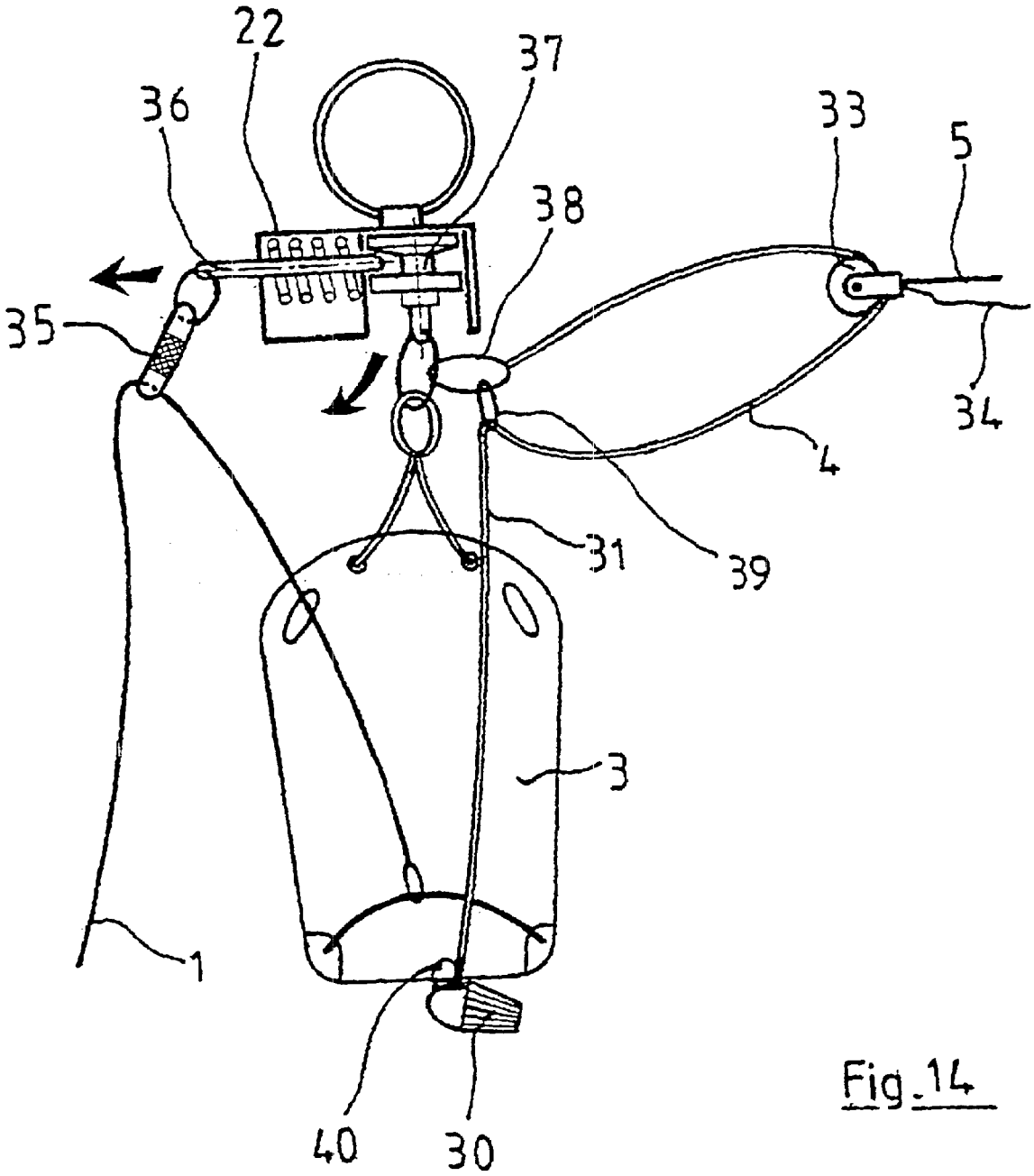
FIG. 14 is a detailed view showing the securement of the release of the device.
Figure 15:
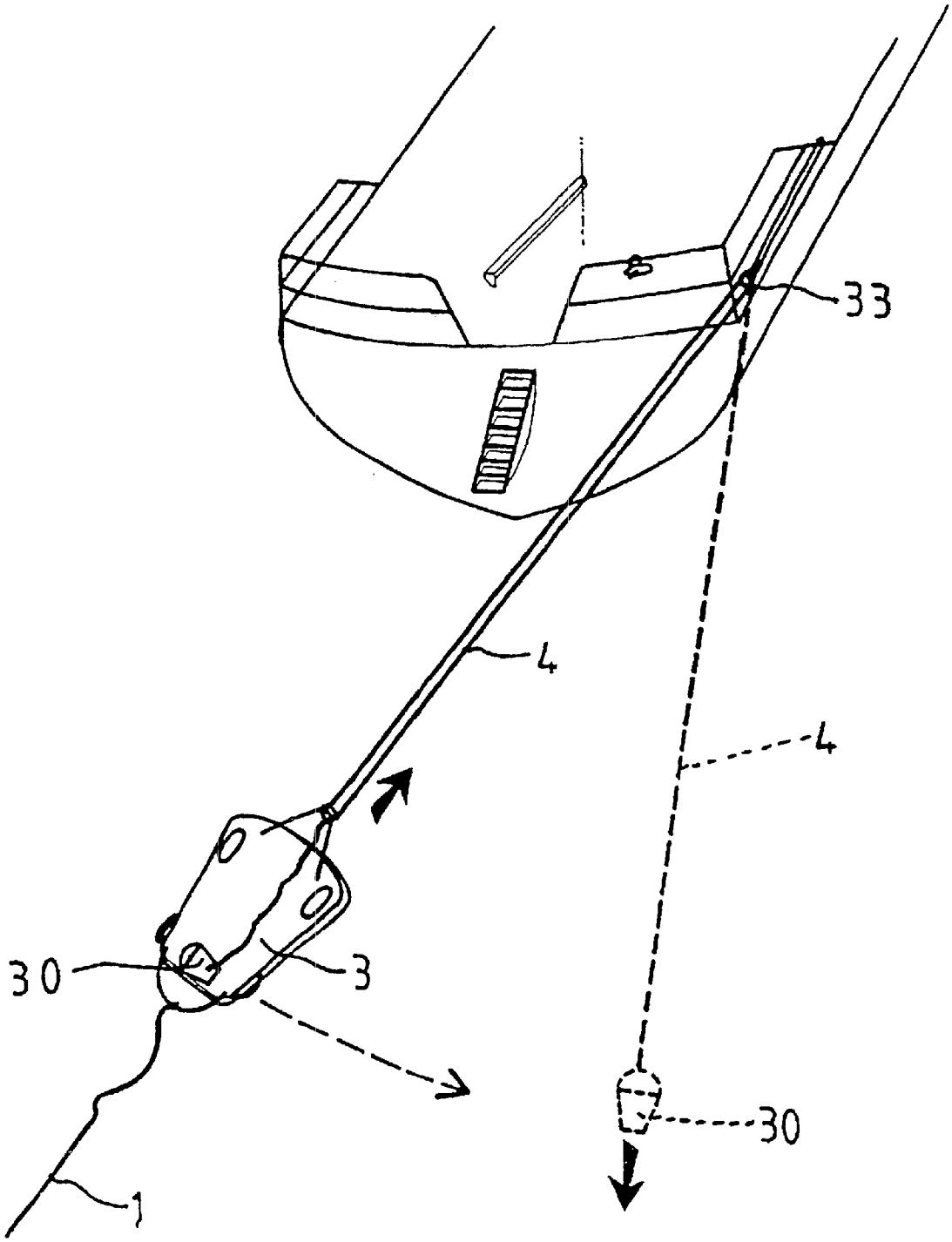
FIG. 15 is a schematic view of the operation of the device and of hoisting the flotation element by the floating anchor.

The device according to the invention shown in FIGS. 13, 14 and 15 comprises the same elements plus a floating anchor 30 which serves as a hoist 7.

In FIG. 13, the device is fixed by its quick release device 22 which is itself fixed to the railing 20 or to the rear platform.

The floating anchor 30 is fixed to the flotation element or floating board 3. It is connected by a rope 31 to the towrope 4 which is partially coiled in a storage bag 32 which is secured onboard. Said pulley 33 is secured to the filing 20 by an end 34 whilst a shock absorber 5 is disposed between said pulley 53 and the point of securement on the railing 20.

As shown in FIG. 14, by pulling on the floating end 1, the victim pulls on the rapid attachment 35 which maneuvers the pin 36 which frees the counterweight 37 thereby freeing the device from its station. The quick coupling 35 opens under traction. The assembly of the device falls into the water.

The snap clasps 38 permits freeing the snap clasp 39 to which is secured the towrope prolonged by the rope 31 of the floating anchor 30.

The loop 40 is opened by the victim to release the floating anchor 30 which falls into the water.

When the floating anchor 30 falls into the water, the rope 31 and the towrope 4 are stretched and all the traction is imposed on the snap clasp 38.

Once the person who has fallen into the water is on the floating plank 3, he can release the floating anchor 30, by detaching the loop 40 and by opening the snap clasp 39, which because of the speed of the boat and the return pulley 33, brings in the direction of the arrow F1 said floating plank 3 toward the boat.

According to these last embodiment, the floating anchor 30 need not be connected to the double towrope 4 which passes through the pulley 33 but can be attached to the floating board 3 in another environment.

In this case, it is thus the victim himself who snaps the floating anchor 30 onto an end of the towrope (and not automatically) and who then frees this end of the flotation plank 3.

Objects and advantages of the present invention:

Thus, in addition to the objects and advantages of the lifesaving system for a person overboard that already exists, several objectives and advantages of the present invention are:

a) —to provide a flotation element to the victim in all cases, b) —to provide an immovable flotation element on the water at the time at which the victim falls in, c) —to provide a flotation element connected to the boat, d) —to provide a flotation element illuminated at night, e) —to provide a floating element that can be rapidly actuated, which is not necessary to start up, thereby savings precious seconds, f) —to provide a floating element which will be as effective on one surface as on the other, which is symmetric as to each surface relative to its horizontal plane, g) —to provide a floating element which can be drawn behind a boat at high speed, with the victim on it, without him being submerged or immersed, h) —to provide a flotation element which will raise the body of the victim out of the water so as to reduce the resistance to traction, i) —to provide the victim the possibility of returning alone to the boat by pulling on the rope, j) —to provide a flotation element with a sufficient hand grip that the victim can be hoisted above the water level without risk of losing his grip, k) —to provide a battery and lamp for nocturnal illumination of the board, l) —to provide a means for recharging this battery automatically, m) —to provide automatic contact which will illuminate or extinguish the lamp, n) —to provide an automatic mechanism onboard the boat to rewind the rope which tows the victim in the water, o) —to provide an inflatable flotation element, hence of small size once folded, p) —providing a reusable launcher to launch the folded inflatable element far behind the boat, q) —to provide a contact for the victim triggered by the launcher, r) —to provide an aerodynamic container to introduce therein the deflated floating element that the cannot will launch.

REFERENCES

1. Floating trailing end
2. Boat
3. Flotation element—floating plank
4. Floating end serving as a towrope
5. Shock absorber
6. Victim
7. Hoist
8. Launcher
9. Container 10. Gripping element
11. Tube
12. Support
13. Adjustable feet
14. Foot
15. Gas reserve
16. Actuating attachment
17. Fixed rings
18. Control lever
19. Enrollment drum
20. Railing
21. Deck
22. Release device
23. Protective packaging
24. Ring
25. Trigger
26. Radio control
27. Microreceiver
28. Small rope
29. Electric motor
30. Floating anchor
31. Floating anchor rope
32. Storage bag
33. Return pulley
34. Securement end of the pulley
35. Quick coupling
36. Pin
37. Counterweight
38. Snap clasp for attachment of the end 4 to the floating board 3
39. Snap clasp for releasing which can be freed from the snap clasp 38 and which connects the towrope 4 and the floating anchor rope
40. Securement loop for the floating anchor

What is claimed is:

1. Onboard device for self-recovery of a conscious person overboard, the device comprising: a floating trailing end adapted to be grasped by a person overboard; a towable flotation element for the person overboard with safety and emergency material for lifesaving; the floating trailing end serving as control means for actuating the release of the flotation element;

said flotation element being connected to a boat by an end serving as a towrope comprising at least one shock absorber means;

said flotation element comprising a floating board and having a hydrodynamic shape for supporting the person partially or entirely out of the water with a minimum of resistance to towing through the water;

said flotation element being symmetrical on each surface relative to its horizontal plane and being provided with towing attachments;

said device further comprising hoist means for hoisting and raising the towrope, the floating element, and the person onboard.

2. The device according to claim 1, wherein the flotation element comprises at least one gripping element to facilitate the person overboard leaving the water.

3. The device according to claim 1, further comprising a launcher onboard the boat adapted to launch the flotation element connected to the towrope in a container in the form of a shell.

4. The device according to claim 3, wherein the launcher onboard the boat adapted to launch the flotation element is triggered by traction on the floating trailing end.

5. The device according to claim 4, wherein the launcher onboard the boat adapted to launch the flotation element is triggered by a radio control carried by the person.

6. The device according to claim 1, wherein the flotation element is disposed in a support from aboveboard in an unstable equilibrium retained in place by a fragile cord connected by a ring to the floating trailing end.

7. The device according to claim 1, wherein the hoist means is a floating anchor secured to one of the ends of the end serving as a towrope while the other end is secured to the flotation element; said end passing through a return pulley mounted onboard the boat.

8. The device according to claim 7, wherein the floating anchor is mounted on the flotation element where it can be released to the water by the person.

* * * * *